US006682166B2

(12) United States Patent
Shimizu

(10) Patent No.: US 6,682,166 B2
(45) Date of Patent: Jan. 27, 2004

(54) INK JET RECORDING APPARATUS

(75) Inventor: Yoichiro Shimizu, Tokai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 25 days.

(21) Appl. No.: 10/171,548

(22) Filed: Jun. 17, 2002

(65) Prior Publication Data

US 2002/0196306 A1 Dec. 26, 2002

(30) Foreign Application Priority Data

Jun. 26, 2001 (JP) ..... 2001-192628

(51) Int. Cl.[7] ..... B41J 2/165
(52) U.S. Cl. ..... 347/30
(58) Field of Search ..... 347/30, 29, 22, 347/20; 15/300.1, 246.2

(56) References Cited

U.S. PATENT DOCUMENTS 6,241,336 B1 * 6/2001 Muraki

* cited by examiner

*Primary Examiner*—Raquel Yvette Gordon
(74) *Attorney, Agent, or Firm*—Oliff & Berridge, PLC

(57) ABSTRACT

In a purge apparatus for use with a color ink jet printer, a suction member that sucks a nozzle surface of an ink jet head is integral with a suction cap and a cap holder that receives the suction cap therein. A suction adapter to which a suction tube is connected is integral with the cap holder. An air-communicating adapter to which an air-communicating tube is connected is formed separately from the cap holder. The air-communicating adapter is loosely supported in the cap holder.

22 Claims, 4 Drawing Sheets

INK JET RECORDING APPARATUS

BACKGROUND OF THE INVENTION

1. Field of Invention

The invention relates to an ink jet recording apparatus that records recording media such as sheets of paper, by ejecting ink onto them.

2. Description of Related Art

Conventionally, an ink jet recording apparatus, for example, is known as a recording apparatus that produces records of prints by ejecting ink onto a recording medium such as paper. The ink jet recording apparatus is provided with a purge apparatus that sucks waste ink including air bubbles generated in the ink jet head.

The purge apparatus is provided so as to move between a stand-by area and a recording area. For example, FIG. 4 shows the conventional purge apparatus which includes a suction cap 3 that covers a nozzle surface of an ink jet head 1, a cap holder 4 that holds the suction cap 3, and two adapters 7 (hereinafter referred to as a suction-side adapter 7*a* and an air-communicating side adapter 7*b*, if a distinction is needed) that connect a suction tube 5 and an air-communicating tube 6 with the suction cap 3 via the cap holder 4.

The suction cap 3 is made of an elastic member such as rubber and has a substantially rectangular shape. The suction cap 3 has an abutting portion 17 and a recess 8 on the surface, and two holes 16 for inserting the two adapters 7 on the back.

The cap holder 4 is made of resin and internally formed with peripheral side wall 9 and a bottom wall 10, which is shaped like a letter H in a sectional view. The surface of the suction cap 3 where the recess 8 is formed is held open, the rear surface of the suction cap 3 is brought into intimate contact with the bottom wall 10, and the periphery of the suction cap 3 is brought into intimate contact with the peripheral side wall 9. Thus, the cap holder 4 elastically maintains the suction cap 3 therein.

Each of the two adapters 7 is shaped in a pipe passing through the bottom wall 10 of the cap holder 4, and includes a front side protruding portion 14 that protrudes from a front surface of the bottom wall 10 and a rear side protruding portion 15 that protrudes from a rear surface of the bottom wall 10, which are integral with the cap holder 4.

Each front-surface protruding portion 14 is elastically inserted into the corresponding hole 16 formed in the suction cap 3, so that the two adapters 7 are connected to the suction cap 3 in a sealed state.

The suction tube 5 is connected with the rear-surface protruding portion 15 of the suction-side adapter 7*a* at one end and the suction pump 11 at the other end. The air-communicating tube 6 is connected with the rear-surface protruding portion 15 of the air-communicating side adapter 7*b* at one end, and released to air at the other end. The solenoid 12 is disposed in the middle of the air-communicating tube 6 so as to open and close the air-communicating tube 6 in accordance with a back-and-forth movement of the plunger 13.

During purge operation, the nozzle surface 2 of the ink jet head 1 is disposed in face-to-face relation with the suction cap 3. With the upward motion of the suction cap 3, the abutting portion 17 makes contact with the nozzle surface 2, and the airtight space 18 is formed between the recess 8 and the nozzle surface 2. When the suction cap 3 makes contact with the nozzle surface 2, the air-communicating tube 6 is previously released to air to prevent compressed air from entering nozzles. The plunger 13 of the solenoid 12 is advanced to close the air-communicating tube 6. The suction pump 11 is activated to suck waste ink in the ink jet head 1 from the suction cap 3 via the suction tube 5 and the suction side adapter 7*a*.

In the purge apparatus, the two adapters 7 are integral with the cap holder 4. To reliably seal between the suction cap 3 and the two adapters 7, it is necessary to accurately form diameters of the front-surface protruding portions 14 of the two adapters 7 and the diameters of the two holes 16 of the suction cap 3. Further, it is necessary to accurately produce a pitch X between the two front-surface protruding portions 14 of the adapters 7, and a pitch Y between the two holes 16 of the suction cap 3, so as to align with each other. However, to reproduce the pitches X and Y accurately takes a lot of trouble, leading to an increase in parts cost.

SUMMARY OF THE INVENTION

The invention provides an ink jet recording apparatus having a purge apparatus that can ensure reliable sealability between a suction cap and a connecting member which are simply and reliably connected via a cap holder.

According to one aspect of the invention, an ink jet recording apparatus includes an ink jet head and a purge apparatus. The ink jet head includes a plurality of nozzles that eject ink onto a recording medium, and a nozzle surface on which the nozzles are arranged. The purge apparatus sucks ink in the ink jet head therefrom. The purge apparatus includes a plurality of connecting tubes, a suction cap that covers the nozzle surface of the ink jet head, a cap holder that holds the suction cap, and an at least one connecting member that connects the suction cap and at least one of the connecting tubes.

According to another aspect of the invention, an ink jet recording apparatus includes an ink jet head and a purge apparatus. The ink jet head includes a plurality of nozzles that eject ink onto a recording medium, and a nozzle surface on which the nozzles are arranged. The purge apparatus sucks ink in the ink jet head therefrom. The purge apparatus includes a plurality of connecting tubes, a suction cap that covers the nozzle surface of the ink jet head, a cap holder that holds the suction cap and includes a connecting portion that connects the suction cap and a first connecting tube of the connecting tubes, and a connecting member that is supported in the cap holder and connects the suction cap and a second connecting tube of the connecting tubes.

BRIEF DESCRIPTION OF THE DRAWINGS

The invention will be described in greater detail with reference to preferred embodiments thereof and the accompanying drawings wherein.

DETAILED DESCRIPTION OF PREFERRED EMBODIMENTS

Figure 1:
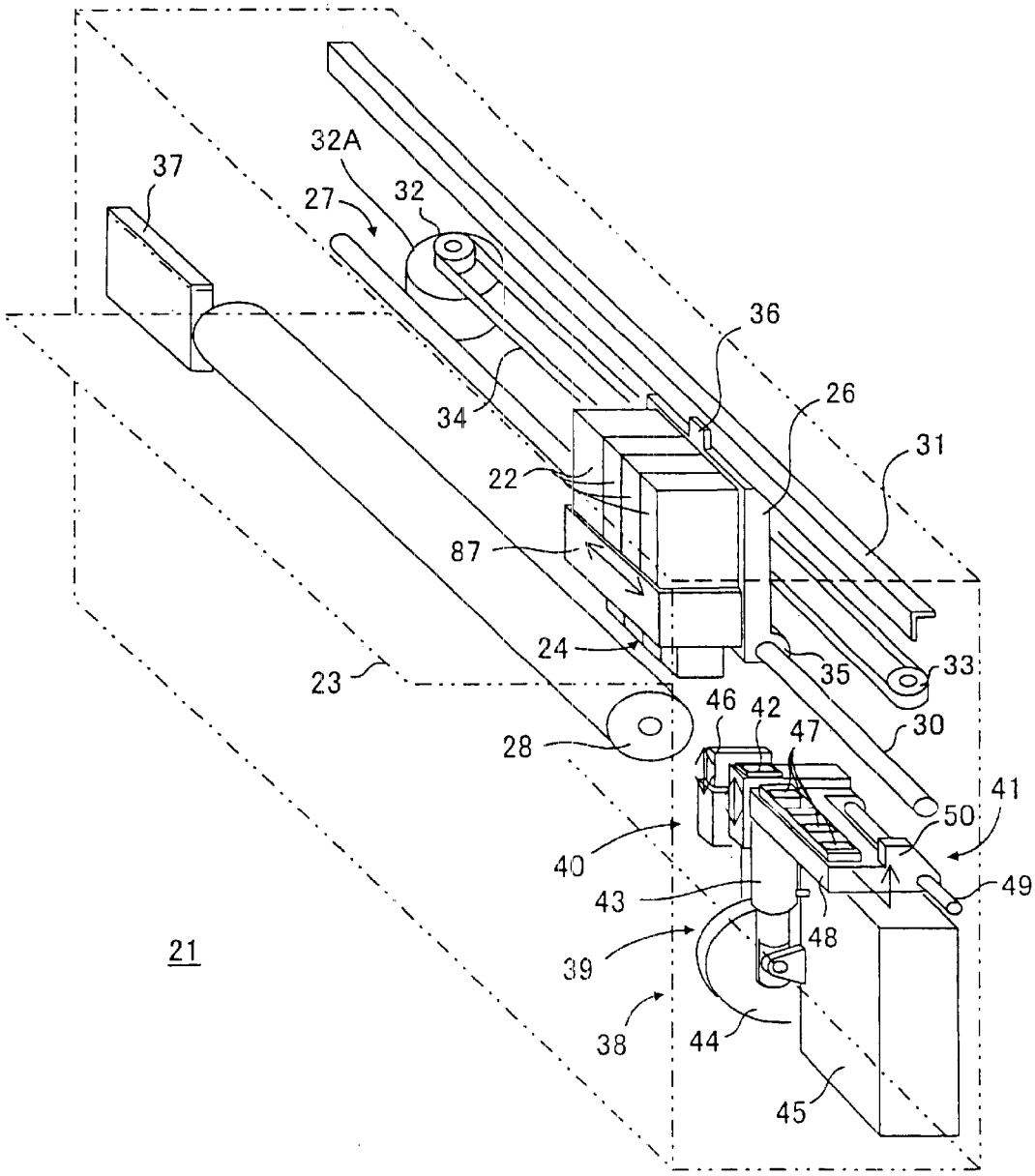
FIG. 1 is a perspective view of a color ink jet printer as an ink jet recording apparatus according to one embodiment of the invention.

As shown in FIG. 1, a color ink jet printer 21 includes ink cartridges 22, ink jet heads 24, a carriage 26, a driving unit 27, a platen roller 28, a maintenance unit 38, and a waste ink absorbent member 37. The ink cartridges 22 contain four color inks cyan, magenta, yellow and black. The ink jet heads 24 are used to print images onto a sheet 23. The ink cartridges 22 and the ink jet heads 24 are mounted on the carriage 26, which is reciprocated linearly by the driving unit 27. The platen roller 28 extends to a direction where the carriage 26 is reciprocated, and faces the ink jet heads 24.

The driving unit 27 includes a carriage shaft 30, a guide plate 31, two pulleys 32, 33, and an endless belt 34. The carriage shaft 30 is disposed at a lower part of the carriage 26 and extends parallel to the platen roller 28. The guide plate 31 is disposed at an upper part of the carriage 26 and extends parallel to the carriage shaft 30. The two pulleys 32, 33 are disposed on both ends of the carriage shaft 30 between the carriage shaft 30 and the guide plate 31, and the endless belt 34 is looped around the two pulleys 32, 33.

The carriage 26 is provided with a carriage shaft supporting portion 35, into which the carriage shaft 30 is inserted, at the lower end thereof, and a guide plate abutting portion 36, which makes contact with the guide plate 31, at the upper end thereof. The endless belt 34 is bonded to the rear surface of the carriage 26.

When the pulley 32 is rotated in a normal or reverse direction by motor 32A, the carriage 26 bonded to the endless belt 34 is linearly moved along the carriage shaft 30 and the guide plate 31. Thereby, the carriage 26 mounting the ink jet heads 24 can be moved across a recording area where a sheet 23 is recorded, and a maintenance area and a flushing area which are located on both sides of the recording area.

The sheet 23 is supplied from a supply paper cassette (not shown) provided on a side of the color ink jet printer 21. The sheet 23 is fed between the ink jet heads 24 and the platen roller 28, where printing is made by ink ejected from the ink jet heads 24, and then, ejected from the printer 21. In FIG. 1, a paper supply mechanism and a paper ejection mechanism for sheets 23 are omitted.

Figure 3:
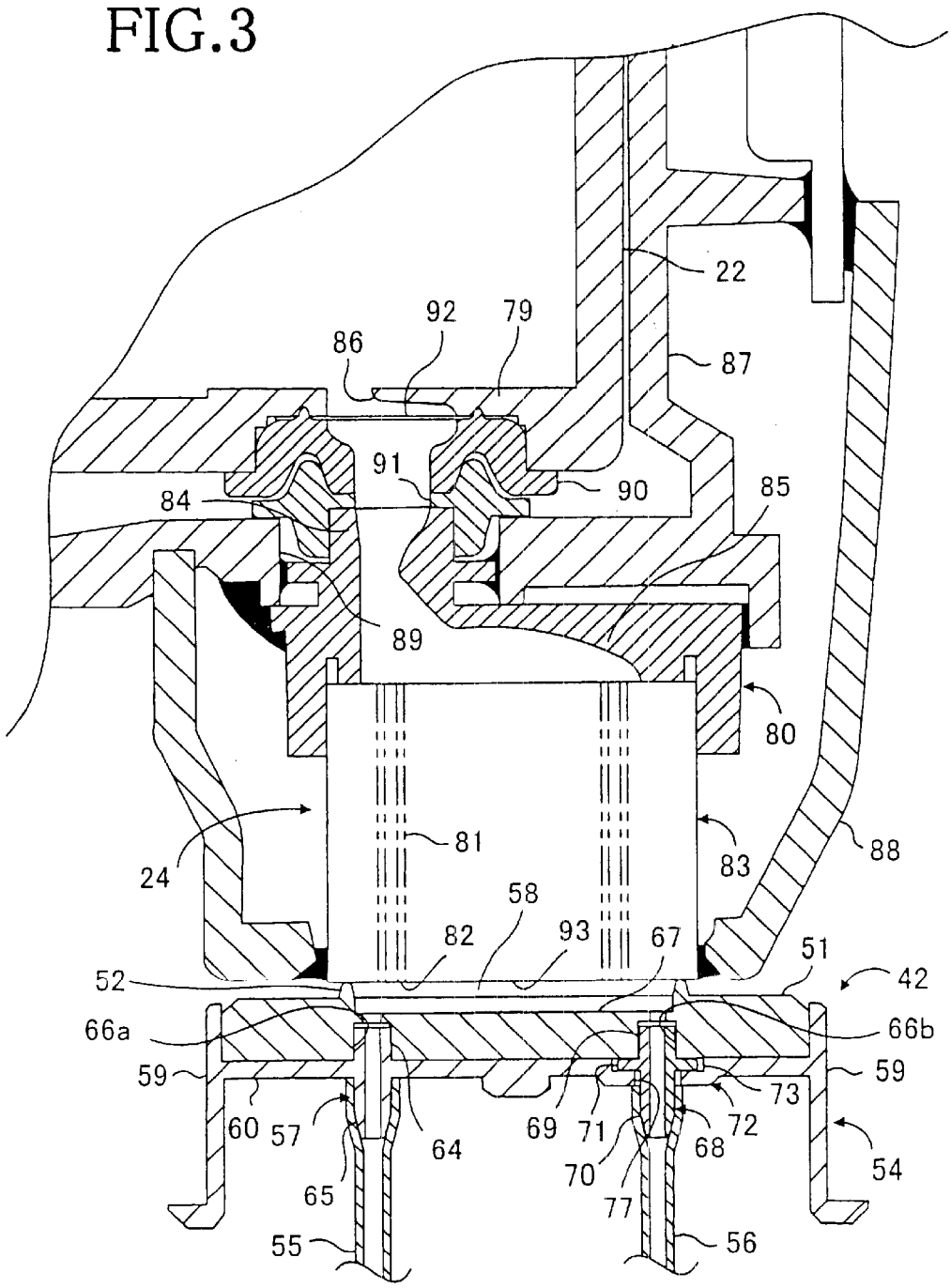
FIG. 3 is an enlarged side sectional view of the substantial parts of the color ink jet printer of FIG. 1 when a suction cap makes contact with an ink jet head.
Figure 4:
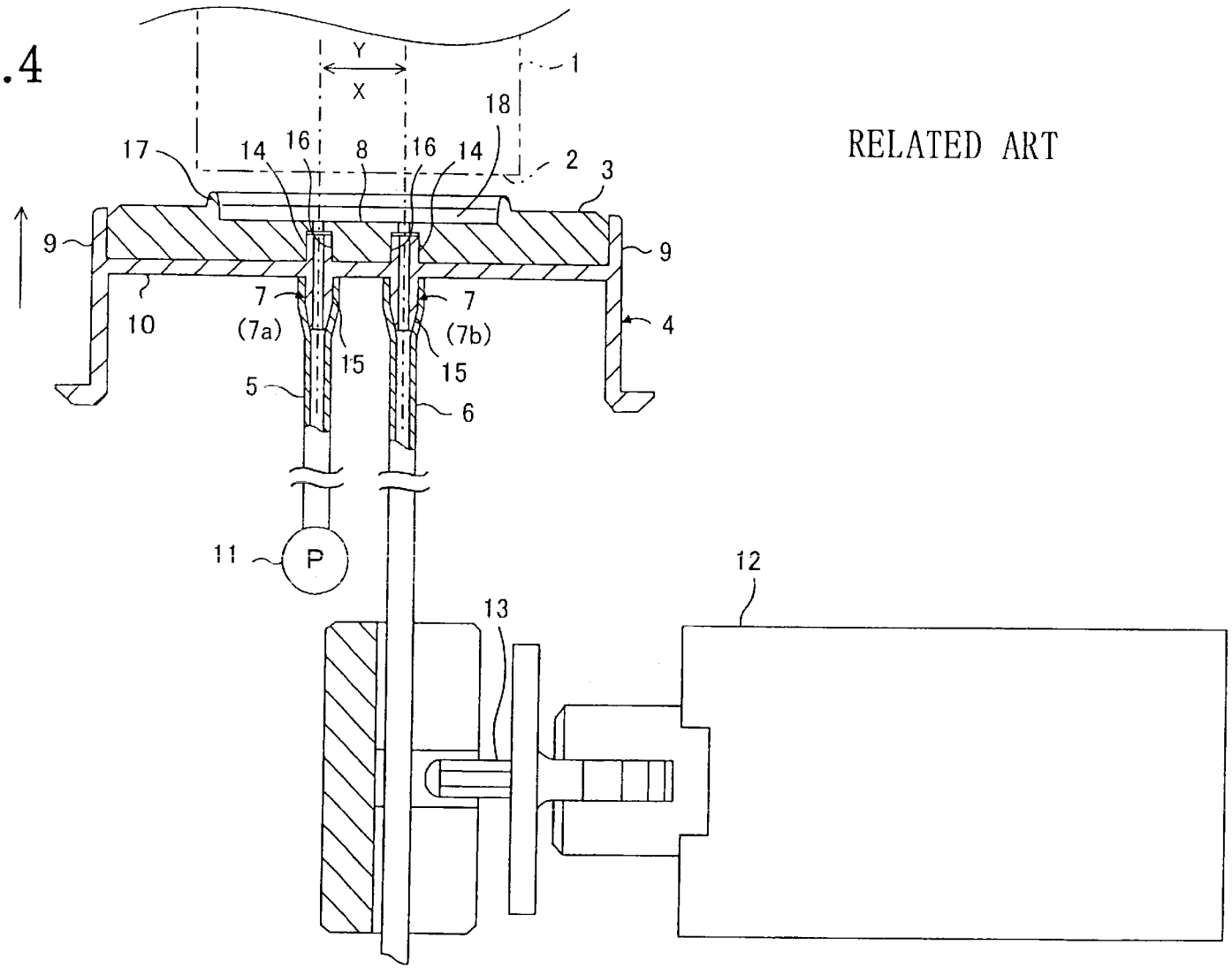
FIG. 4 is a side sectional view of the substantial parts of a purge apparatus of a conventional color ink jet printer.

As shown in FIG. 3, each ink cartridge 22 is mounted in the head holder 87, and has an ink supply port 86 for supplying ink to each ink jet head 24 that opens at a bottom wall 79 thereof. A sealing member 90, which is a ring-shaped elastic member, is fitted in an opening below the ink supply port 86 with a filter 92 being interposed therebetween. The sealing member 90 is engaged with an adapter 91 that connects a manifold 80.

The head holder 87 has a holder hole 89 at a position opposite to the ink supply port 86. The adapter 91 is inserted into the holder hole 89. Each ink jet head 24 includes an actuator 83 having a plurality of ejection channels 81 for ejecting ink droplets of ink therein from nozzles 82, and the manifold 80 which is joined to the actuator 83 to supply ink to each of the channels 81 in the actuator 83.

The manifold 80 is made of resin and is integral with an ink introducing portion 84 which introduces ink from the ink cartridge 22, and an ink supply portion 85 which supplies ink to each of the ejection channels 81. The ink introducing portion 84 of the manifold 80 is inserted into the adapter 91 via the holder hole 89, so that it is connected to the ink supply port 86 of the ink cartridge 22 via the adapter 91 and the sealing member 90.

The ink introducing portion 84 is adhesively secured to the holder hole 89 of the head holder 87, so that the ink jet head 24 is supported in the head holder 87. Ink in the ink cartridge 22 is supplied from the ink supply port 86 to the ink supply portion 85 via the ink introducing portion 84 of the manifold 80, and delivered from the ink supply portion 85 to each of the ejection channels 81 of the actuator 83.

The actuator 83 is made of a piezoelectric ceramic material. The bottom surface of the actuator 83 is a nozzle surface 93 having nozzles 82 which are opened in a one-to-one relationship with ejection channels 81. Ink supplied to each ejection channel 81 in the actuator 83 is ejected as ink droplets from each nozzle 82 when the volume of the actuator 83 decreases. When the volume of the actuator 83 increases, ink is supplied from the ink supply portion 85 to the ejection channels 81. With repetition of the operation of changing the volume of the actuator 83, a predetermined printing is formed on a sheet.

The head holder 87 is provided with a head cover 88 that covers the ink jet heads 24 with the nozzle surface 93 of the actuator 83 being exposed. The maintenance unit 38 is disposed in the maintenance area at one side of the recording area as shown in FIG. 1, and includes a purge apparatus 39, a wiping apparatus 40, and a preservative capping apparatus 41.

The purge apparatus 39 includes a suction member 42 that sucks the nozzle surface 93 of each ink jet head 24, a pump 43 that sucks ink in the ink jet heads 24 via the suction member 42, a solenoid mechanism 53 that hermetically seals or releases the airtight space 58 (as shown FIG. 2), a cam 44 that causes the suction member 42 to move according to the moving path of the ink jet heads 24, and an ink reservoir 45 where waste ink is collected.

Figure 2:
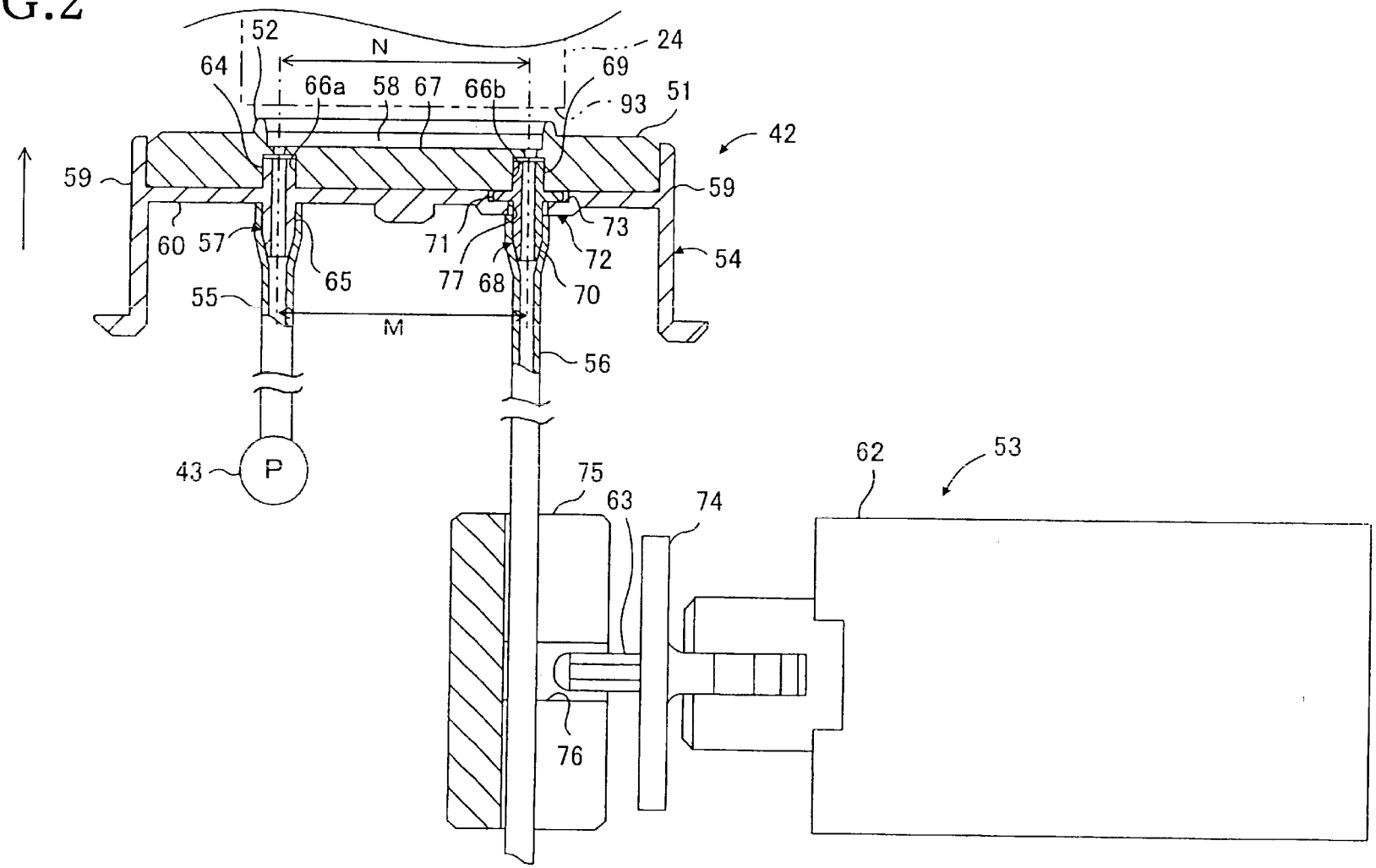
FIG. 2 is a side sectional view of the substantial parts of a purge apparatus of the color ink jet printer of FIG. 1.

As shown in FIGS. 2 and 3, the suction member 42 includes a suction cap 51 that covers the nozzle surface 93 of the ink jet head 24, a cap holder 54 that holds the suction cap 51, a suction adapter 57 that connects the suction cap 51 with a suction tube 55 via the cap holder 54, and an air-communicating adapter 68 that connects the suction cap 51 with an air-communicating tube 56 via the cap holder 54.

The suction cap 51 is made of an elastic member such as rubber having a substantially rectangular shape. The suction cap 51 includes, on the surface, an abutting portion 52 that protrudes from the surface so as to abut on the nozzle surface 93 of the ink jet head 24, and a recess 67 defined by the abutting portion 52. The recess 67 forms an airtight space 58 which is to be hermetically sealed. On the rear surface of the suction cap 51, two holes, a suction-side hole 66*a* and an air communicating-side hole 66*b*, are formed in places opposite to both ends of the nozzle surface 93 with respect to the direction of an array of the nozzles 82, so as to communicate with both ends of the recess 67 in the suction cap 51.

The cap holder 54 is made of resin and has a substantially "H" shaped cross-sectional configuration where the peripheral side wall 59 and the bottom wall 60 are integral with each other. The surface of the suction cap 51 where the recess 67 is formed is held open, the rear surface of the suction cap 51 is brought into intimate contact with the bottom wall 60, and the periphery of the suction cap 51 is brought into intimate contact with the peripheral side wall 59. Thus, the cap holder 54 elastically maintains the suction cap 51 therein.

The suction adapter 57 and a connecting portion 72 for mounting the air-communicating adapter 68 are integral with the bottom wall 60. The suction adapter 57 is provided at a place opposite to the suction-side hole 66*a*, and is shaped in a tube passing through the bottom wall 60 of the cap holder 54. A front-surface protruding portion 64 that protrudes from the front surface of the bottom wall 60, and a rear-surface protruding portion 65 that protrudes from the rear surface of the bottom wall 60, are integral with the cap holder 54. The front-surface protruding portion 64 is elastically inserted into the suction-side hole 66*a* formed in the suction cap 51, so that the suction adapter 57 is connected with the suction cap 51 in a sealed state.

The connecting portion 72 is disposed at a place opposite to the air communicating-side hole 66*b*. A connection-recess 73 that receives a flange 71 of the air-communicating adapter 68, is integral with the cap holder 54 on the top surface of the bottom wall 60. An air-communicating side connection hole 77 where a lower tube portion 70 of the air-communicating adapter 68 is inserted, is also integral with the cap holder 54.

The connection recess 73 has a larger diameter than the flange 71 so as to provide for a determined clearance around the flange 71. Thus, the connection recess 73 can receive the flange 71 in a loosely inserted state. The air-communicating side connection hole 77 is formed so as to pass through the bottom wall 60 at the center of the connecting portion 72, and to be larger than the lower tube portion 70 of the air-communicating adapter 68 in diameter.

The air-communicating adapter 68 has a tube-like shape and includes an upper tube portion 69 that protrudes from the front surface of the bottom wall 60, a lower tube portion 70 that protrudes from the rear surface of the bottom wall 60, and a ring-shaped flange 71 that projects radially between the upper tube portion 69 and the lower tube portion 70. In the air-communicating adapter 68, the lower tube portion 70 is loosely inserted into the air communication side connection hole 77 from the front surface of the bottom wall 60, and the flange 71 makes contact with the connection recess 73. The air-communicating adapter 68 is maintained in position in the vertical direction, and loosely supported in the connection portion 72 in the horizontal direction. In addition, the upper tube portion 69 of the air-communicating adapter 68 is elastically inserted into the air communicating-side hole 66*b* formed in the suction cap 51, so that the air-communicating adapter 68 is connected to the suction cap 51 in a sealed state.

The suction tube 55 is connected with the rear-surface protruding portion 65 of the suction adapter 57 at one end, and the pump 43 at the other end. With this structure, the pump 43 is constructed to suck ink in the corresponding one of the ink jet heads 24 opposite to the recess 67 from the suction adapter 57 via the suction tube 55.

The air-communicating tube 56 is connected with the lower tube portion 70 of the air-communicating adapter 68 at one end, and released to air at the other end. A solenoid mechanism 53 that opens and closes the air-communicating tube 56 is provided in the midstream of the air-communicating tube 56.

The solenoid mechanism 53 includes a support plate 75 that supports the air-communicating tube 56 therein, and a solenoid 62 having a plunger 63 that advances or retracts in an insertion hole 76 of the support plate 75. The plunger 63 has a stopper 74 of a flat-plate shape that maintains the position of the plunger 63 advancing in the insertion hole 76 by making contact with the support plate 75.

In the solenoid mechanism 53, when the solenoid 62 is excited, the plunger 63 advances until the stopper 74 makes contact with the support plate 75, the end of the plunger 63 presses against the air-communicating tube 56, and the air-communicating tube 56 is closed. When the solenoid 62 is not excited, the plunger 63 retracts, and the air-communicating tube 56 is released.

The cam 44 is disposed under the pump 43 as shown in FIG. 1, and is constructed to cause the suction member 42 to reciprocate between an advancing position and a retracting position. In the advancing position, the suction cap 51 covers the nozzle surface 93 of the ink jet head 24 in a hermetically sealed state. In the retracting position, the suction cap 51 is separated from the nozzle surface 93. The ink reservoir 45 is located at a lower portion of the preservative capping apparatus 41 so as to store waste ink sucked by the pump 43.

In the purge apparatus 39, during the purge operation of the ink jet heads 24, the carriage 26 is moved to cause the nozzle surface 93 of the ink jet head 24 to face the suction cap 51. The cam 44 is driven by a driving source (not shown), and the suction member 42 is advanced so that the suction cap 51 covers the nozzle surface 93 in intimate contact with each other. The solenoid 62 is excited, and the plunger 63 is advanced to close the air-communicating tube 56. The pump 43 is driven to suck waste ink (including air or ink that is becoming viscous) in the ink jet head 24 from the suction tube 55 via the suction adapter 57. Thus, the ink jet head 24 is recovered.

The wiping apparatus 40 is located adjacent to the recording area with respect to the purge apparatus 39 in the maintenance area. The wiping apparatus 40 includes a wiper blade 46 that elastically makes contact with the nozzle surface 93. The wiper blade 46 is comprised of a thin rectangular plate, and made of an elastic material such as ethylene propylene rubber.

The wiping apparatus 40 is configured to move up or down in accordance with the traveling route of the ink jet heads 24 driven by the cam 44 of the purge apparatus 39. In the wiping apparatus 40, the wiper blade 46 moves up to elastically make contact with the nozzle surface 93 of each ink jet head 24 moving between the recording area and the maintenance area, to wipe the nozzle surface 93. Ink adhered to the wiper blade 46 is collected in the ink reservoir 45 as in the case of ink sucked by the purge apparatus 39.

The preservative capping apparatus 41 is located adjacent to the purge apparatus 39 in the maintenance area, and four caps 47 corresponding to the ink jet heads 24 are arranged in parallel on the casing 48. The casing 48 has an engageable protrusion 50 outside the caps 47 and is slidably and movably supported to the guide rod member 49 extending parallel to a direction of the carriage 26 is moved. When the carriage 26 is moved from the recording area to the maintenance area, the moving carriage 26 engages the engageable protrusion 50 of the casing 48, and the caps 47 slide in accordance with the movement of the carriage 26. The caps 47 are rotated in a direction to approach the ink jet heads 24 by a sloping cam (not shown), so as to cover the nozzle surface 93 of each ink jet head 24 in a hermetically sealed state. The nozzle surface 93 of each ink jet head 24 which is not used for printing is covered with the corresponding cap 47, thereby preventing ink from vaporizing and preventing the nozzle surface 93 from drying. When the carriage 26 is moved toward the recording area, the caps 47 are separated from the ink jet heads 24 by an operation reverse to the above.

The waste ink absorbent member 37 is disposed in the flushing area on the other end of the recording area. The waste ink absorbent member 37 is structured to absorb ink preliminarily ejected from the ink jet heads 24 just before printing operation in order to eliminate clogging of the nozzles 82 and remove ink including air from the nozzles 82.

A series of operations of the color ink jet printer 21 will be described with reference to FIG. 1. In the printer 21, before a printing operation is started, the ink jet heads 24 are located in the maintenance area and covered with the caps 47. When the printing operation is started, the sheet 23 is fed between the platen roller 28 and the ink jet heads 24, the carriage 26 is moved to separate the ink jet heads 24 from the caps 47, and the ink jet heads 24 are moved into the recording area. Based on predetermined recording data, the ink jet heads 24 eject ink onto the sheet 23 during a reciprocating motion. In this manner, a predetermined recording is made on the sheet 23. When the printing operation is completed, the carriage 26 is moved from the recording area to the maintenance area, so that the caps 47 cover the nozzle surface 93 of each ink jet head 24 again.

The purge operation for the ink jet heads 24 is ordered by the user or at predetermined intervals. The carriage 26 drives a specified ink jet head 24 for which the purge operation is ordered to move to a position opposite to the suction cap 51. The cam 44 is driven by a driving source (not shown), and the suction member 42 is advanced. As shown in FIG. 3, the abutting portion 52 of the suction cap 51 is brought into contact with the nozzle surface 93 of the ink jet head 24, each nozzle 82 of the nozzle surface 93 is covered in the airtight space 58 created by the nozzle surface 93, the abutting portion 52, and the recess 67. As shown in FIG. 2, the solenoid 62 is excited, the plunger 63 is advanced until the stopper 74 makes contact with the support plate 75, and the air-communicating tube 56 is closed. Thus, the airtight space 58 is obstructed from air. The pump 43 is driven to suck waste ink in the ink jet head 24 from the suction tube 55 via the suction adapter 57. The pump 43 is stopped to decrease the negative pressure in the airtight space 58, and left stand until the flow of the sucked waste ink disappears. The excitation of the solenoid 62 is interrupted so that the plunger 63 is retracted and the air-communicating tube 56 is held open. By doing so, the airtight space 58 is released to air. The pump 43 is driven again to suck ink adhered on the nozzle surface 93 and the recess 67 in a ventilated state. Then, the pump 43 is stopped and the cam 44 is driven to separate the suction cap 51 from the ink jet head 24. This completes the purge operation.

When the purge operation is completed, the suction member 42 is retracted and the wiper blade 46 is advanced. The carriage 26 is moved to move the ink jet head 24 when the purge operation has been completed in a direction to cross over the wiper blade 46, which wipes the nozzle surface 93 of the ink jet head 24.

During the printing operation, surplus ink is accumulated on the nozzle surface 93 as a result of repeated ink ejection from the nozzles 82, which may lead to an ejection failure. Thus, at fixed intervals, the wiper blade 46 is advanced and the carriage 26 is moved in the direction that the ink jet head 24 crosses over the wiper blade 46, and the nozzle surface 93 of the ink jet head 24 is wiped by the wiper blade 46.

In the suction member 42 of the purge apparatus 39, while the suction adapter 57 is integral with the cap holder 54, the air-communicating adapter 68 is separate from the cap holder 54. If the pitch M does not accurately match with the pitch N in the formation of the cap holder 54 and the suction cap 51, play of the air-communicating adapter 68 to be loosely inserted into the connecting portion 72 allows simple and reliable connection between the cap holder 54 and the suction cap 51 by adjusting the suction adapter 57 and the connecting portion 72 to the suction-side hole 66*a* and the air communicating-side hole 66*b*, respectively.

Thus, the suction cap 51, the cap holder 54, the suction adapter 57, and the air-communicating adapter 68 can be formed simply, resulting in a reduction of parts cost. In addition, the suction cap 51 can be connected with the suction adapter 57 and the air-communicating adapter 68 via the cap holder 54, so that tight sealability can be ensured.

In the suction cap 51, the suction adapter 57 and the air-communicating adapter 68 are disposed at positions facing toward both ends with respect to a direction the nozzles 82 are arranged on the nozzle surface 93 of the ink jet head 24. After waste ink is removed, suction is performed in a ventilated state. At this time, ink adhered on the nozzle surface 93 and the recess 67 can be thoroughly removed by air to be sucked from the nozzles 82 at one end to the nozzles 82 at the other end. As a result, the purge operation can be performed without waste ink remaining.

As the suction adapter 57 is integral with the cap holder 54, the suction cap 51 is easily mounted in the cap holder 54 with reference to the suction adapter 57. With this simple and accurate mounting method, the suction cap 51, the suction adapter 57 and the air-communicating adapter 68 can be further reliably connected with each other.

In the above description, while the suction adapter 57 is integral with the cap holder 54, the air-communicating adapter 68 is separate from the cap holder 54. However, on the contrary, the air-communicating adapter 68 may be integral with the cap holder 54 and the suction adapter 57 may be separate from the cap holder 54. Alternatively, the suction adapter 57 and the air-communicating adapter 68 may be separate from the cap holder 54.

In the above description, one suction adapter 57 and one air-communicating adapter 68 are provided. However, the invention is not limited to the number of adapters and the aspects of the embodiment. For example, a plurality of suction adapters and/or air-communicating adapters may be provided. The suction adapter 57 and the air-communicating adapter 68 may be connected with two suction tubes to perform suction by the two suction tubes.

What is claimed is:

1. An ink jet recording apparatus, comprising:

an ink jet head, comprising:

a plurality of nozzles that eject ink onto a recording medium; and a nozzle surface on which the nozzles are arranged;

a purge apparatus that sucks ink in the ink jet head therefrom, the purge apparatus comprising:

a plurality of connecting tubes; and a suction cap that covers the nozzle surface of the ink jet head;

a cap holder that holds the suction cap; and at least one connecting member that connects the suction cap and at least one of the connecting tubes.

2. The ink jet recording apparatus according to claim 1, wherein the suction cap has an at least one communicating hole that communicates with the at least one connecting member.

3. The ink jet recording apparatus according to claim 2, wherein the suction cap has a recess facing the nozzle surface, and the at least one communicating hole is located in a place facing an end of the nozzles arranged on the nozzle surface, in the recess.

4. The ink jet recording apparatus according to claim 2, wherein the at least one connecting member is inserted into the at least one communicating hole.

5. The ink jet recording apparatus according to claim 4, wherein the at least one connecting member is loosely supported in the cap holder.

6. The ink jet recording apparatus according to claim 1, wherein the purge apparatus further includes a pump, a first connecting tube connected to the pump, a second connecting tube is released to air, and communication of air is interrupted in the second connecting tube during a purge operation.

7. The ink jet recording apparatus according to claim 1, wherein the cap holder has an at least one connecting portion.

8. An ink jet recording apparatus, comprising:

an ink jet head, comprising:

a plurality of nozzles that eject ink onto a recording medium; and a nozzle surface on which the nozzles are arranged;

a purge apparatus that sucks ink in the ink jet head therefrom, the purge apparatus comprising:

a plurality of connecting tubes; and a suction cap that covers the nozzle surface of the ink jet head;

a cap holder that holds the suction cap and includes a connecting portion that connects the suction cap and a first connecting tube of the connecting tubes; and a connecting member that is supported in the cap holder and connects the suction cap and a second connecting tube of the connecting tubes.

9. The ink jet recording apparatus according to claim 8, wherein the suction cap has communicating holes that communicate with the connecting portion and the connecting member.

10. The ink jet recording apparatus according to claim 9, wherein the connecting portion and the connecting member are fit into the communicating holes.

11. The ink jet recording apparatus according to claim 10, wherein the connecting member is loosely supported in the cap holder.

12. The ink jet recording apparatus according to claim 8, wherein the suction cap has a recess facing the nozzle surface, and the communicating holes are located at positions facing both ends of the nozzles arranged on the nozzle surface.

13. The ink jet recording apparatus according to claim 8, wherein the purge apparatus further includes a pump, the first connecting tube is connected to the pump, the second connecting tube is released to air, and communication of air is interrupted in the second connecting tube during a purge operation.

14. A suction cap mechanism for purging an ink jet head, comprising:

a cap holder having a one of a suction adapter and an air communicating adapter integral with the cap holder and passing through a base of the cap holder, and a through-hole through the base of the cap holder, the through-hole surrounded by a recess, the other of the suction adapter and the air communicating adapter received in the through-hole, the other of the suction adapter and the air communicating adapter having a flange at a position between each end and received in the recess of the cap holder; and a suction cap seated in the cap holder and sealingly engaged with an end of the suction adapter and an end of the air communicating adapter, the suction cap having a hole passing therethrough to correspond to a passage through each of the suction adapter and the air communicating adapter.

15. The suction cap mechanism according to claim 14, wherein the suction cap has a recess opposing the ink jet head and an abutting portion circumscribing the recess in the suction cap for engaging the ink jet head.

16. The suction cap mechanism according to claim 15, further comprising:

an air tube connected to the air communicating adapter;

a pressure cut off mechanism that engages and closes the air tube;

a suction tube connected at one end to the suction adapter; and a pump connected to the other end of the suction tube.

17. The suction cap mechanism according to claim 14, wherein the suction adapter and the air communicating adapter are positioned substantially at opposite ends of a nozzle array of the ink jet head.

18. The suction cap mechanism according to claim 14, wherein the recess in the cap holder is larger than outer dimensions of the flange of the other of the suction adapter and the air communicating adapter.

19. The suction cap mechanism according to claim 16, wherein the through-hole through the cap holder is larger than outer dimensions of the other of the suction adapter and the air communicating adapter passing therethrough.

20. The suction cap mechanism according to claim 19, wherein the suction adapter and the air communicating adapter are positioned substantially at opposite ends of a nozzle array of the ink jet head.

21. The suction cap mechanism according to claim 14, wherein there are a plurality of suction adapters, a plurality of air communicating adapters, and a plurality of through-holes.

22. A suction cap mechanism for purging an ink jet head, comprising:

a cap holder having a plurality of through-holes through a base of the cap holder, each of the through-holes surrounded by a recess;

an air communicating adapter and a suction adapter disposed in the through-holes, wherein each of the air communicating adapter and the suction adapter has a flange at a position between each end thereof and received in a recess of the cap holder; and a suction cap seated in the cap holder and sealingly engaged with an end of the suction adapter and an end of the air communicating adapter, the suction cap having a hole passing therethrough to correspond to a passage through each of the suction adapter and the air communicating adapter.

* * * * *